US008985615B2

(12) United States Patent
Wollo et al.

(10) Patent No.: US 8,985,615 B2
(45) **Date of Patent: *Mar. 24, 2015**

(54) LOCKING MECHANISM FOR SKI BINDIN

(71) Applicant: Rottefella AS, Klokkarstua (NO)

(72) Inventors: Even Wollo, Naersnes (NO); Aksel Pettersen, Drobak (NO); Thomas Holm, Oslo (NO); Oyvar Svendsen, Oslo (NO)

(73) Assignee: Rottefella AS, Klokkarstua (NO)

( * ) Notice: Subject to any disclaimer, the term of this patent is extended or adjusted under 35 U.S.C. 154(b) by 0 days.

This patent is subject to a terminal disclaimer.

(21) Appl. No.: 14/338,680

(22) Filed: Jul. 23, 2014

(65) Prior Publication Data

US 2014/0333048 A1 Nov. 13, 2014

Related U.S. Application Data

(62) Division of application No. 13/389,009, filed as application No. PCT/EP2009/060103 on Aug. 4, 2009, now Pat. No. 8,801,026.

(51) Int. Cl.

| | |
|---|---|
| ***A63C 9/00*** | (2012.01) |
| ***A63C 9/20*** | (2012.01) |
| ***A63C 9/02*** | (2012.01) |

(52) U.S. Cl.

CPC .... *A63C 9/20* (2013.01); *A63C 9/02* (2013.01)
USPC ..... 280/615; 280/11.31; 280/11.33; 280/117.2; 280/614; 280/616; 280/632; 280/607; 280/611; 280/631; 72/324

(58) Field of Classification Search

USPC ..... 280/11.31, 11.33, 117.2, 614, 615, 616, 280/632

See application file for complete search history.

(56) References Cited

U.S. PATENT DOCUMENTS

| | | | | | |
|---|---|---|---|---|---|
| 4,367,885 | A * | 1/1983 | Ramer | 280/614 |
| 4,887,833 | A * | 12/1989 | Bailey | 280/615 |
| 5,087,065 | A * | 2/1992 | Provence et al. | 280/615 |
| 5,338,053 | A * | 8/1994 | Hauglin | 280/615 |
| 5,669,622 | A * | 9/1997 | Miller | 280/615 |
| 6,027,135 | A * | 2/2000 | Hauglin | 280/615 |
| 6,065,769 | A * | 5/2000 | Simonetti et al. | 280/615 |
| 6,168,184 | B1 * | 1/2001 | Simonetti et al. | 280/615 |
| 7,210,698 | B2 * | 5/2007 | Dandurand | 280/614 |
| 7,966,752 | B2 * | 6/2011 | Grandin et al. | 36/117.5 |
| 2004/0056449 | A1 * | 3/2004 | Girard et al. | 280/615 |

FOREIGN PATENT DOCUMENTS

| | | |
|---|---|---|
| WO | 97/47367 | 12/1997 |

OTHER PUBLICATIONS

International Search Report for corresponding Patent Application No. PCT/EP2009/060103 dated Apr. 16, 2010.

* cited by examiner

*Primary Examiner* — J. Allen Shriver, II
*Assistant Examiner* — Hilary L Johns
(74) *Attorney, Agent, or Firm* — Renner, Otto, Boisselle & Sklar, LLP

(57) ABSTRACT

The present disclosure relates to a single piece base portion (10) for a locking mechanism (30) for a ski binding (1), in particular a cross country or touring ski binding. The base portion (10) comprising: a planar resting portion (11); one or more, preferably two, support sections (12) extending out of the plane of the planar resting portion (11). In particular, each of the support sections (12) comprises an axle pin hole (13) for receiving an axle (21) of a part associated with the locking mechanism (30). Further, the lowest section (14) of the axle pin hole (13) is aligned with the upper surface (15) of the planar resting portion (11).

7 Claims, 5 Drawing Sheets

(a)

(b)

(c)

(a)

(b)

(a)

(b)

(c)

(a)

(b)

(c)

(a)

(b)

(c)

LOCKING MECHANISM FOR SKI BINDIN

RELATED APPLICATION DATA

This application is a divisional of U.S. patent application Ser. No. 13/389,009 filed Apr. 3, 2012, which is a U.S. National Phase Application of International Application No. PCT/EP2009/060103 filed Aug. 4, 2009, which are all hereby incorporated herein by reference in their entirety.

BACKGROUND TO THE INVENTION

It is common in cross-country or touring skiing for the skier to wear a special boot for integrating with the binding of the ski. Typically, the ski boot is provided with a rotation pin, which is used to integrate with an appropriate clip on the ski binding 1. The rotation pin on the ski boot is usually provided around the toe region of the boot, thus allowing the skier to lift the heel of the ski boot from the ski to allow a classic ski motion.

In order for the binding to interact appropriately with the ski boot via the rotation pin, some sort of clip in the binding is typically provided. This clip attaches to the rotation pin of the ski boot, and fixes the ski boot to the binding in a rotatable manner. A variety of known systems and methods for this attachment exist, and can include the binding having a moveable element which allows a suitable recess to be opened or closed so as to allow the positioning and fixing of the rotation pin of the ski boot.

In cross-country skiing it is most important for the skier to have an accurate sensation through the ski and binding to the boot as to the exact snow conditions. This so called "snow touch" is of particular relevance for professional cross-country skiers, and is very important to ensure that the skier gets a good feeling of when the ski properly bites into the snow. With a good snow touch through the skis, the skier is better able to hone his or her technique to ensure that the precise timing of the snow biting is felt, which allows for the skier to perfect their skiing for the particular snow conditions. In order to improve the snow touch for a ski and binding, it has been noted that the lower the rotation point for the rotation pin of the ski boot to the snow, the better. Even reducing the distance between the rotation point and the snow surface by a few millimeters, drastically improves the sensation the skier gets of the actual snow touch, and greatly improves the skiing performance.

The present application is directed to the design of a base plate for use in a locking mechanism to be integrated with a ski binding, wherein the fixing point for the rotation pin of the ski boot is provided at a very low position. This ensures that the ski boot, and in particular the rotation pin thereof, is very close to the snow surface.

SUMMARY OF THE INVENTION

The present invention provides a base portion 10 for a locking mechanism 30 for a ski binding 1 in accordance with independent claim 1, as well as a process for its manufacture given in claim 11. Further preferred embodiments are given in the dependent claims.

The claimed invention can be better understood in view of the embodiments of the base portion 10 and process described hereinafter. In general, the described embodiments describe preferred embodiments of the invention. The attentive reader will note, however, that some aspects of the described embodiments extend beyond the scope of the claims. To the respect that the described embodiments indeed extend beyond the scope of the claims, the described embodiments are to be considered supplementary background information and do not constitute definitions of the invention per se. This also holds for the subsequent "Description of the Figures" as well as the "Description of the Preferred Embodiments."

In particular, the present disclosure relates to a base portion 10 formed from a single piece of material, wherein the base portion 10 is to be integrated into a locking mechanism 30, which in turn is for integrating further with a ski binding 1. The base portion 10 preferably comprises a specific planar resting portion 11, which is an extended section of the base portion 10, used for resting the base portion 10 on. In particular, it is expected that the resting portion 11 will be used as the lower surface of the locking mechanism 30, and that this will rest either on the upper surface 15 of the ski or on an appropriate surface within the binding. Extending out of the plane of the resting portion 11 are provided one or more support sections 12. Preferably two support sections 12 are provided extending in the same direction out of the plane of the resting portion 11, wherein the support portions may provide the double purpose of housing the rotation pin of the ski boot, as well as a rotation axle 21 for attaching a locking means of the locking mechanism 30 to the base portion 10.

The support sections 12 may be provided with a hole passing there through, which will allow an axle 21 to be threaded through the one or more support sections 12, thus rotatably attaching a further portion of the locking mechanism 30 to the base portion 10. Most preferably, the lowest point of this axle pin hole 13 is aligned with the upper surface 15 of the planar resting portion 11. By providing the axle pin hole 13 in this location, it is possible to still fit the axle pin 32 through the pin holes in order to connect the base portion 10 to the locking means to create the locking mechanism 30, and further this provides an extremely low point for the rotation of the locking means thus allowing for a very low profile base portion 10. In addition to the very low profile base portion 10, it goes without saying that means provided on the base portion 10 for interacting with the rotation pin of the ski boot would also be positioned at a very low point, thus allowing for a ski boot to be attached to a binding via the locking mechanism 30 at a very low point, thus also meaning this is very close to the snow.

The base portion 10 as described above provides a very compact design, in that the height of the support sections 12 may be kept to the minimum height to impart enough strength to the base portion 10 to hold both the boot rotation pin and the axle 21 of the locking mechanism 30. In essence, the means for receiving the rotation pin of the ski boot need only be separated from the axle pin hole 13 by the minimum distance for strength purposes, thus allowing a general reduction in the thickness of the base portion 10. With this reduced thickness, as has already been stated, it is possible for the rotation pin of the ski boot to be brought much closer to the surface of the snow, in order to improve the snow touch.

A preferable aspect of the base portion 10, is the provision of an indent for accepting the rotation pin of a ski boot. The boot pin indent may be provided on or in the upper edge of the support sections 12, such that easy access to this indent is afforded. The simplest and most effective design for this boot pin indent is that of a U-shape, which extends downward from the upper edge of the support section. A further possible location for this U-shaped indent, or indent of a different shape as desired, is slightly behind the axle pin hole 13 when considering forward to be the direction of travel of the base plate when attached to a ski.

If the U-shaped indent is provided behind the axle pin hole 13, when the base plate is in use, the action of skiing will tend to keep the locking mechanism 30 locked. This is a result of the skiing motion encouraging the locking means to rotate in the direction of locking the rotation pin into the locking mechanism 30. In other words, as the skier lifts the boot from the surface of the ski and rotates this round the rotation pin$_1$ a slight upward and forward rotational motion will be imparted to the rotation pin. If the boot pin indent is provided behind the axle pin hole 13 the act of pulling the rotation pin upward will tend to cause the locking means to rotate in such a way that the locking means are induced to keep the lock in a closed position. This system leads to a restriction, stopping the disengagement of the rotation pin from the boot pin indent.

It is further preferable for the base plate to be provided with a cut-out section passing through the plate making up the single piece base portion 10. Further this cut-out is in a location between the support sections 12 and the planar resting portion 11 around the axle pin hole 13. In particular$_1$ the cut-out may be provided by a somewhat flat bottomed U-shape curve, or straight-lined shape. The flat bottom passing underneath the axle pin hole 13 as determined when resting on the flat base, and the two side portions extending upwards and partly round the axle pin hole 13.

The base portion 10 as described above is preferably obtained as a result of its production process. In particular, a patterned sheet may be provided through which the axle pin hole 13 and cut-out are cut, punched or otherwise formed. By provision of such a blanked or punched sheet, a simple bending action of sections of the this punched sheet out of the plane of the sheet, will readily form the one or more support sections 12. If the bend is located such that it passes through the side portions of the cut-out either side of the axle pin hole 13, the region of the sheet around the axle pin hole 13 will tend to follow the plane of the support sections 12 as they are rotated, but will not be deformed by provision of the bend. If the bend is appropriately located, it is possible to bend the axle pin hole 13 out from the plane of the punched sheet and resulting planar resting portion 11, to ensure that the lowest portion of the axle pin hole 13 appropriately aligns with the upper surface 15 of the planar resting portion 11. Further$_1$ as the cut-out separates the section of material comprising the axle pin hole 13 from planar resting portion 11, the axle pin hole 13 will not be deformed and will thus appropriately allow an axle pin 32 to be passed there-through, in order to allow production of a locking mechanism 30.

It is also further possible to provide the gap between the axle pin hole 13 and the closest side of the cut-out, such that after bending the section of the base portion 10 lying underneath the axle pin hole 13 will appropriately align with the lower surface of the planar resting portion 11. This will thus mean that the support sections 12 are further supported by either the upper surface 15 of the ski, or the section of the binding element, in the region below the axle pin hole 13 and the boot pin indent. As has been described above$_1$ the base portion 10 can be incorporated into a locking mechanism 30, wherein the locking mechanism 30 would further comprise locking means which are rotatably attached thereto. The locking means could be attached by means of an axle 21 passing through the axle pin hole 13 of the base portion 10, so as to rotatably attach the locking means to the base portion 10, and also part of the locking mechanism 30.

Should the locking means be provided with their own secondary axle pin holes 34, the locking mechanism 30 could provide a single axle 21 passing through each of the axle pin holes 34 in both the support sections 12 and the locking means, so as to provide the locking mechanism 30. Preferably, the locking means are comprised of two elongate arm members which have hook portions for holding the rotation pin of the ski boot to the locking mechanism 30. In particular, the hook portions could be provided on the elongate arm members near the secondary axle pin holes 34. The hook portions could be appropriately structured such that when the axle pin 32 is provided through the axle pin holes 34 in the support members and the secondary pin holes in the elongate arm members, rotation of the elongate arm will lead to the hook portion overlapping with the boot pin indent to provide an appropriate fastening. This fastening would hold the rotation pin to the locking mechanism 30.

In particular, the hook portions could be appropriately curved such that when the elongate arms are in the locked orientation, the resulting hole defined by the inner surfaces of the hook portion and the lower portion of the U-shaped boot indent are circular, and further the same size as the rotation pin of the ski boot. In this way, the rotation pin of the ski boot will be tightly held in the locking mechanism 30 without any additional play, and indeed such a locking mechanism 30 could provide near 100% coverage around the rotation pin of the ski boot.

In order to attach the above described base portion 10 and locking mechanism 30 to a ski, it is possible to provide an appropriately structured ski binding 1. The ski binding 1 could comprise an elongate member, which has appropriate connecting means for attaching to the upper surface 15 of a ski or a mounting plate attached to the ski. On the side opposite the ski mounting side of the elongate member, appropriate structure may be provided to interact with, and allow the mounting of, a ski boot. In particular, the elongate member may be provided with an appropriately sized and positioned recess on the underside which could receive the base plate as described above.

It would also be preferable if the upper side of the elongate member comprised a hole which passed through to the recess, or at least a part thereof, so as to allow the one or more support section to pass through, such that they may be accessed from the upper side of the elongate member. In structuring the holes and recess in this manner, the support members, and in particular the boot indent thereof, are accessible from the upper side of the binding, and thus the rotation pin of the ski boot can be appropriately located in the boot pin indent. Further, the hole is obviously structured such that the locking means of the locking mechanism 30 are provided above the elongate member such that the locking mechanism 30 can be opened and closed as desired. In this situation, the planar resting portion 11 not only provides the lower surface to which the locking mechanism 30 rests on the upper surface 15 of the ski, but also ensures that the locking mechanism 30 cannot pass through the holes in the elongate member, thus holding the locking mechanism 30 within the ski binding 1.

As has been touched on above, a process for producing the base portion 10 for the locking mechanism 30 begins with provision of an appropriate material sheet. In particular, it is expected that a metallic sheet would be provided, as this provides the necessary material strength. Of course, any specific material with the necessary strength characteristics could be substituted for a metal sheet. The sheet is then patterned, preferably by punching, blanking or cutting the sheet, so as to define a patterned or punched sheet. The patterning of this rigid sheet is preferably done in a single step and appropriately defines the axle pin hole 13, the cut-out in the region of the pin hole, as well as sections which form a precursor for the support sections 12.

The method continues by bending the sections which will form the support sections 12 out of the plane of the patterned sheet, so as to form the one or more support sections 12. In particular, the bend is provided in a region which passes through side extensions of the cut-out positioned either side of the axle pin holes 34, so that the axle pin hole 13 is also bent out of the plane of the patterned sheet. The axle pin hole 13 thus forms part of the support section, wherein the cut-out ensures that the region of material around the axle pin hole 13 is not deformed by bending, and thus the axle pin hole 13 is also not deformed by the bending action. Further, the provision and position of the bend is such that the lowest section 14 of the axle pin hole 13 can be appropriately aligned with the upper surface 15 of the unbent metal or rigid sheet.

In the patterning step of the rigid sheet, it is possible to further define a boot pin indent which is of an appropriate size to receive the rotation pin of the ski boot. The boot pin indent can be provided slightly offset from the axle pin hole 13, and further preferably provided slightly behind the axle pin hole 13 in the direction of travel of the base portion 10 when this is integrated with a ski binding 1.

A locking mechanism 30 may be provided from the above described base portion 10 by providing a locking means with an appropriate number of secondary axle pin holes 34. Further, the locking means are structured with hook portions in the region of the secondary axle pin holes 34, such that when an axle 21 is passed through all of the axle pin holes 34 to connect together the locking means and the base portion 10, the hook portions can be rotated in and out of a locking orientation overlapping part of the boot pin indent.

DESCRIPTION OF THE PREFERRED EMBODIMENTS

Figure 1:
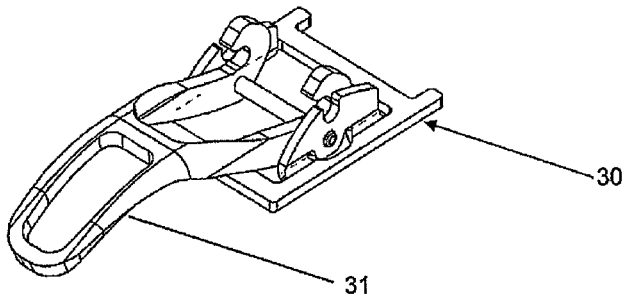
FIG. 1: This figure shows two perspective views of a locking mechanism 30 according to the present disclosure, as well as one exploded view of the same.
Figure 1:
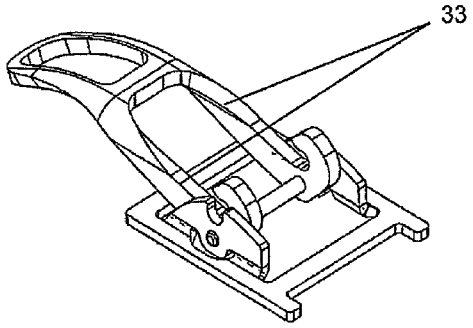
Figure 1:
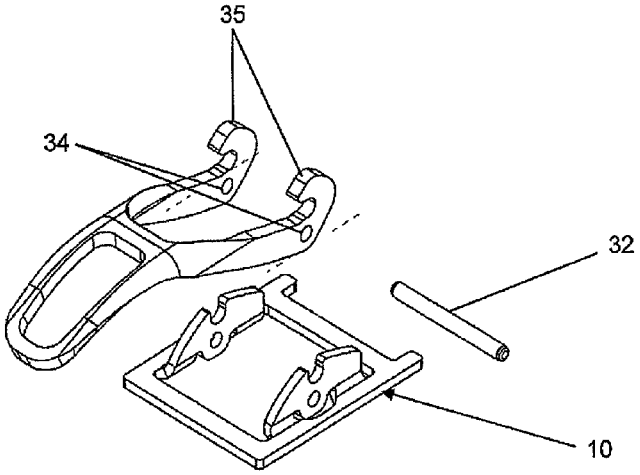

FIG. 1 shows two perspective views at a) and b) of a locking mechanism 30, suitable for integration with a ski binding 1 for a cross country or touring ski. Such a locking mechanism 30 is intended to interact with the rotation pin 2 of the ski boot 3 in a manner which can be seen in FIG. 2*b*, wherein the dotted lines represent the ski boot 3 and rotation pin 2. As is well known in the art, a ski boot 3 for cross country or touring skiing is generally attached to a ski binding 1 by means of a rotation pin 2 attached to the underside, toe portion of the ski boot 3. Such a mechanism applied to a ski boot 3 allows the ski boot 3 to be rotatably attached to the ski binding 1, in order to allow the skier to appropriately ski.

The present disclosure is directed toward providing a ski binding 1 in which the ski boot 3 of the skier is as close to the snow as is possible. As is discussed above, by reducing the distance between the ski boot 3 and the surface of the snow, the sensation or snow touch for the skier is greatly improved. It is typically difficult, however, to simply reduce the thickness of the ski binding 1, and in particular the affixing between the rotation pin 2 and the ski binding 1. This is because if the ski binding 1 is made too thin, the connection between the ski boot 3 and the ski is very weak and can prove dangerous in use as failure of the ski binding 1 can more readily occur.

Looking at the exploded view of the locking mechanism 30 shown in FIG. 1*c*, the locking mechanism 30 is shown as a three piece unit. It is advantageous to have a three piece locking mechanism 30, as this greatly improves and eases manufacturing of the locking mechanism 30, as well as simplifying the design and avoiding failure thereof from too many interacting pieces. In particular, the base portion 10 of the locking mechanism 30 is shown, with this being used to attach locking means 31 into the locking mechanism 30, and also being useful for attaching the locking mechanism 30 to the ski binding 1.

Figure 3:
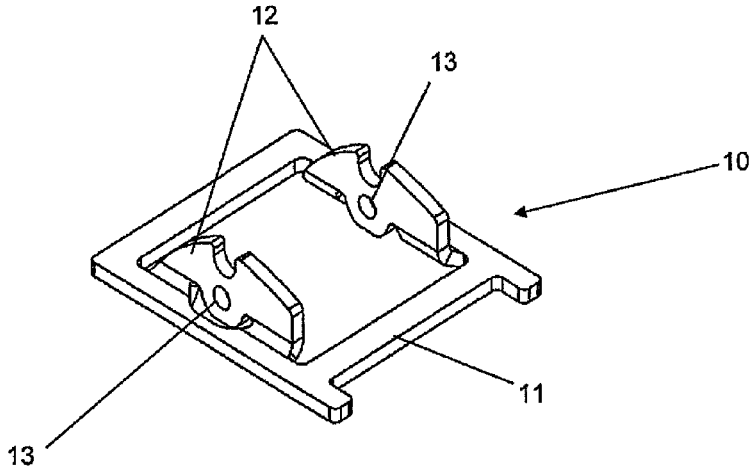
FIG. 3: Various views of the base portion 10 for the locking mechanism 30 of FIGS. 1 and 2, as well as the precursor for the base portion 10.
Figure 3:
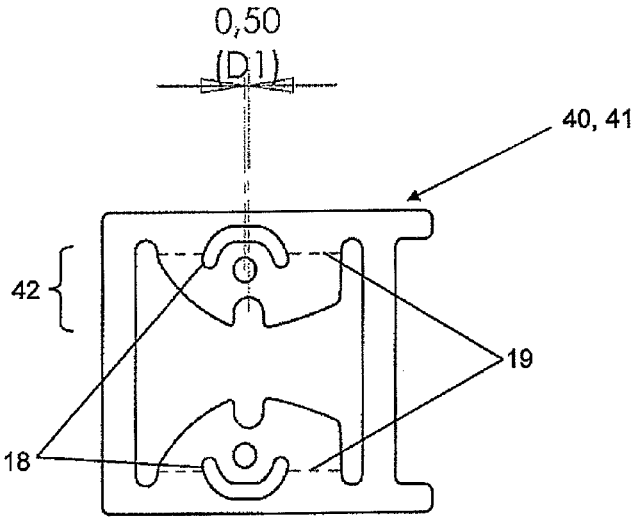
Figure 3:
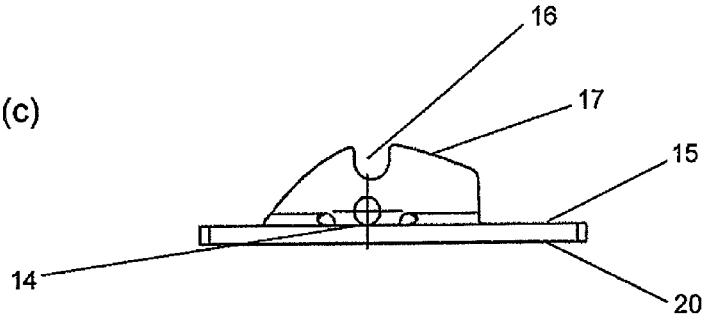

The base portion 10 can be best seen in FIG. 3; this provides a simple mechanism for reducing the eventual height of the ski binding 1, by providing a way of lowering the connection pin between the rotation pin 2 and the ski binding 1. As can generally be seen in FIG. 3*a*, the base portion 10 advantageously comprises a planar resting portion 11, which provides a flat supporting surface and base to the base portion 10. This planar resting portion 11 is preferably designed to interact, and be held within, a ski binding 1, whilst also providing the surface for resting against the top of the ski or an appropriate surface in the ski binding 1.

The width of the planar resting portion 11 may advantageously be chosen to be the same width as the ski, or ski binding 2, to which it will be attached. By choosing the width of the planar resting portion 11 to coincide with the maximum space available, the greatest level of stability can be achieved. As can also be seen in FIG. 3, it is possible to provide the planar resting portion 11 with one or more extensions. These extensions may be provided extending out from the front and/or back of the planar resting portion 11, and further advantageously could be in line with the outermost edges of the planar resting portion 11 in the width direction. Provision of these extensions can improve further the resting stability of the planar resting portion 11, and further its resistance to being rotated out of the ski binding 3 when in use. Further, this can be useful in overcoming possible tolerance issues between the sizes of the base portion 10 and the ski binding 3.

Extending generally upward from the planar resting portion 11 of the base portion 10, are support sections 12. In the figure, two support sections 12 are shown, although it would also be possible to have a single central support section 12, or indeed more than two support sections 12 lined in a row. These support sections 12 are further provided with an axle pin hole 13, wherein the axle pin hole 13 is designed to provide a means for connecting the base portion 10 to further elements of the locking mechanism 30. In the particular design shown, the axle pin hole 13 is intended to interact with an axle pin 32, wherein the axle pin 32 may further interact with the locking means 31. The particular location of the axle pin hole 13 in the base portion 10 is most advantageous in the present disclosure, and, as can be seen best in FIG. 3*c*, the lowest section 14 of the axle pin hole 13 is aligned with the upper surface 15 of the planar resting portion 11. By aligning the axle pin hole 13 in such a way, the axle pin 32 can still be positioned through the one or more axle pin holes 13 to interact with the locking means 31. As is also clear, the rotation point of the locking means 31 is now at the lowest possible point above the resting surface of the locking mechanism 30. This can be seen clearly in FIG. 2, wherein the locking means 31 are shown rotatably attached to the base portion 10 by means of the axle pin 32, the axle pin hole 13 providing a rotation point which is extremely low and close to the bottom of the lowest surface of the locking mechanism 30.

A base portion 10 as described above, can advantageously further provide a boot pin indent 16. This boot pin indent 16 is sized and positioned to receive the rotation pin 2 of an attached ski boot 3. As can further be seen in most of the figures, the boot pin indent 16 is preferably provided in the upper surface 15 or edge 17 of the support sections 12. As is clear from FIG. 2, provision of the boot pin indent 16 in such a location allows for an appropriately shaped locking means 31 for the locking mechanism 30 to rotate around the axle pin 32, to open and close the access to the boot pin indent 16. Further, the boot pin indent 16 can be positioned at the minimum height above the axle pin hole 13, thus reducing the height of the rotation point of the ski boot 3 with respect to the snow. Indeed, choosing the gap between the axle pin hole 13 and the lowest portion of the boot pin indent 16 to be the minimum required for strength, will clearly reduce the overall height of the ski binding 1, thus improving the snow touch for the skier. The support sections 12 comprising the boot pin indent 16, can be advantageously separated by a distance which corresponds with the length of the rotation pin 2 of a ski boot 3. By making the distance between the outer sides of these support section 12 the same as that of the rotation pin 2, the stability of connection between the ski boot 3 and the locking mechanism 30 may be improved.

The boot pin indent 16 can take a variety of shapes, although a preferred shape is that of a U. This U shape will clearly be best served by matching the size of the rotation pin 2, to allow a snug fit with the possibility of rotation of the ski boot 3. It is further possible to provide the locking means 31 with hook portions 35 which will overlap with the open section of the boot pin indent 16. Preferably, the hook portions 35 of the locking means 31 could be so structured that when in the closed position, shown in FIG. 2*a*, the interior surface of the hook portions 35 match the curved section of the U boot pin indent 16, and thus present a generally circular cross sectional channel, as seen in FIG. 2*a*. By structuring the hook portions 35 of locking means 31 in such a manner, the rotation pin 2 is provided with almost 100% circumferential cover, and the fixing between the ski boot 3 and the locking mechanism 30 is improved.

It is further possible to structure the hook portions 35 of the locking means 31 such that part of the end will pass through the rotation pin 2 of a ski boot 3, if attached to the locking mechanism 30. That is, if the hook portions 35 must pass through the rotation pin 2 when this is held in the locking mechanism 30, it is much less likely that the locking mechanism will accidentally open. As the rotation pin 2 will stop the hook portions 35 from passing and opening the locking means 31, the security of such a locking mechanism 30 can be improved.

Returning once again to FIG. 3*a*, it is further clear that the base portion 10 is provided with a cut-out 18. This cut-out 18 is advantageously provided between the planar resting portion 11 and the axle pin hole 13. A preferred shape of the cut-out 18 is shown in FIG. 3*b*, and this cut-out 18 surrounds at least a part of the axle pin hole 13 with two side extensions extending round the outer circumference of the axle pin hole 13. Whilst the cut-out 18 is shown in figures as being curved, it is also possible to provide this by three straight edged lines, which again extend partially round the circumference of the axle pin hole 13.

Figure 2:
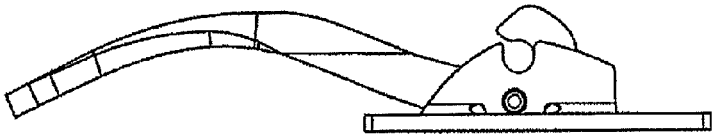
FIG. 2: Two views showing the locking mechanism 30 in a closed and open orientation.
Figure 2:
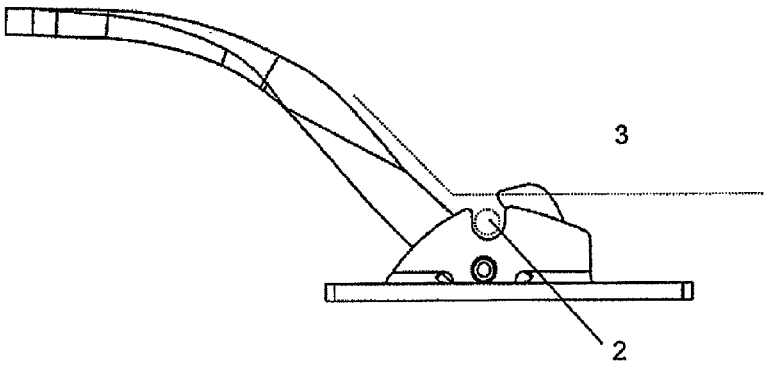

The advantageous reasoning for provision of the cut-out 18, relates to the method of manufacture of the base portion 10. As can be seen in FIGS. 1-3, the base portion 10 is preferably formed from a single piece of material. As is further clear from FIG. 3*b*, the single piece of material can be structured as a patterned sheet 40, which is in turn made from a rigid sheet 41. The patterning of the rigid sheet 41 can be done in a variety of different ways, with these including blanking or stamping the pattern out, cutting or moulding of the material making up the rigid sheet 41. For reasons of strength, the rigid sheet is preferably made from a metallic material, although of course any ceramic or plastic material providing enough strength to survive the skiing action will also be appropriate, and is considered as implicitly covered by means of the term rigid sheet 41.

In FIG. 3*b*, the patterned sheet 40 is shown comprising the axle pin hole 13, the cut-out 18, the planar resting portion 11 and also two sections which are precursors 42 for the support sections 12. Shown in FIG. 3*b* is also the preferred feature of the boot pin indent 16. In order to fabricate the base portion 10 as seen in FIG. 3*a*, the precursors 42 of the support sections 12 are bent up out of the plane of the patterned sheet 40. By positioning the bend 19 such that it crosses the two side sections of the cut-out 18, it is clear that the section of the patterned sheet 40 around the axle pin hole 13 will be bent upward with the support sections 12.

Further, by virtue of the curved cut-out 18 extending around part of the circumferential edge of the axle pin hole 13, the rigid sheet 41 will not be deformed around the axle pin hole 13, and thus the axle pin hole 13 will also not be deformed by the bending.

It is further preferable to provide the distance between the axle pin hole 13 and the cut-out 18 to be the minimum to allow the locking mechanism 30 to function. Clearly the locking mechanism 30 will rotate around the axle pin hole 13, and thus ensuring that this is high enough from the surface of the ski after bending, will improve operation of the locking mechanism 30. Indeed, the resulting material underneath the axle pin hole 13 after bending can rest on the upper surface of the ski, and thus this defines the width which can be used by the locking mechanism 30.

It is also possible to provide the precursors 42 on the outside of the planar resting portion 11, and bend these upward and inward to form the support sections 12. This technique is not so desirable, however, as it tends to mean that the width of the planar resting portion 11 is somewhat reduced in the final base portion 10. In bending the precursors 42 upward, the outer edges of the planar resting portion 11 will also be bent slightly, so as to ensure that the base portion 10 is not too wide to fit within the ski binding 1. The slight bend that results from this bending will mean that slightly less of the underside of the planar resting portion 11 is in contact with the upper surface of a ski, and thus the base portion 10 will be less stable, leading to a less stable overall binding.

After bending the patterned sheet 40, it is clear that the base portion 10 as seen in FIG. 3*a* will be formed. That is, provision of the bend 19 will bend only the connection between the precursors 42 of the support sections 12 and the planar resting portion 11, and the axle pin hole 13 will be bent out of the plane of the pattern sheet 40, and can be appropriately aligned in the support sections 12. Careful choice of the location of the bend 19 will preferably result in the lower sections 14 of the axle pin hole 13 aligning with the upper surface 15 of the planar resting portion 11, as discussed above.

It would also be possible to fashion the cut out 18 such that it extended from the edge of the patterned sheet 40 to the region of the axle pin hole 13. It could be understood that this may also allow for the axle pin hole 13 to be positioned even closer to the upper surface of a ski, as its location would not be limited by the width of the rigid sheet 41. Certain drawbacks exist to this design, however, not least that during the bending of the precursors 42 the entire sheet can more easily be deformed. This deformation can distort the side of the base portion 10, and can lead to this not having an appropriately flat lower surface. Further, if the cut out 18 were to extend to the edge of the base portion 10, it is clear that the general strength of this part would be reduced in this region, which is undesirable as this is the region which is under the greatest stress when in use.

It is also possible to provide the boot pin indent 16 at a location which does not align with the centre of the axle pin hole 13. As can be seen in FIG. 3*b*, the boot pin indent 16 can be misaligned with the centre of the axle pin hole 13, with this misalignment being preferably between 0.1 and 1 mm, or more preferably between 0.3 and 0.7 mm or most preferably, 0.5 mm. This misalignment of the boot pin indent 16 is advantageous when considering the operation of the eventual locking mechanism 30: looking at FIG. 2*a*, when the skier rotates the ski boot 3 such that the heel of the ski boot 3 leaves the surface of the ski, the rotation pin 2 will generally be pulled upward and round in the locking mechanism 30. Providing the boot pin indent 16 at a location which is slightly behind the axle pin hole 13, and thus the axle pin 32 providing the rotation point of the locking means 31, will tend to mean that the upward and anti-clock-wise movement (as seen in FIG. 2*a*) of the rotation pin 2, will generally act to close the locking means 31 in the locking mechanism 30. In other words, provision of the boot pin indent 16 preferably behind the axle pin hole 13, when forward is taken as the skiing direction/tends to provide a locking mechanism 30 which will preferably act to keep itself in the locked position during skiing.

As can be seen in FIG. 1*c*, the locking mechanism 30 may comprise the base portion 10, the axle pin 32 as well as the locking means 31. The locking means 31 can further advantageously be provided by elongate arm members 33 comprising hook portions 35 in the region of secondary axle pin holes 34. With such a preferred design, the secondary axle pin holes 34 are used to attach the one or more elongate arm members 33 to the one more support sections 12 of the base portion 10. As has further been discussed above, locating the hook portions 35 in an appropriate position with respect to the secondary axle pin holes 34, allows for rotation of the elongate arm members 33 to move the hook portions 35 in and out of a locking engagement with respect to the boot pin indent 16. This is again seen in FIGS. 2*a* and 2*b*.

The locking mechanism 30 can be provided with a self-contained locking system, by providing the elongate arm members 33 with a thick portion in the region of the secondary axle pin hole 34. By providing this thicker region underneath the secondary axle pin holes 34, it is clear that the elongate arm members 33 must be distorted slightly in order to move from the open to the closed orientation of the locking mechanism 30. Such a system is provided in co-pending European application number 08 168 676, which is herewith incorporated in its entirety.

Figure 4:
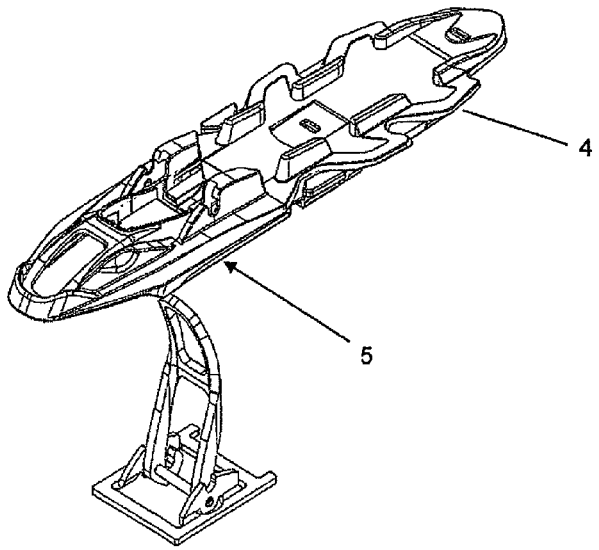
FIG. 4: Method of attaching the locking mechanism 30 of FIGS. 1 and 2 to a ski binding 1 or mounting plate.
Figure 4:
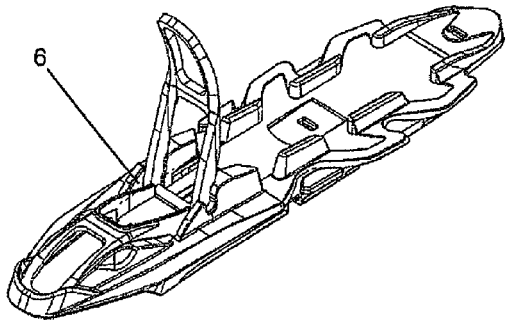
Figure 4:
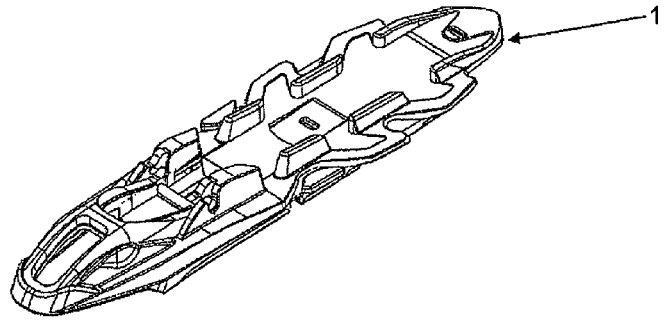
Figure 5:
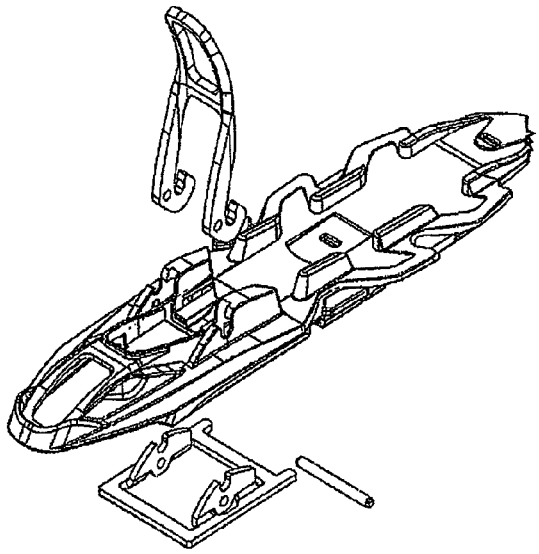
FIG. 5: Alternative method of mounting a locking mechanism 30 to a ski binding 1 or mounting plate.
Figure 5:
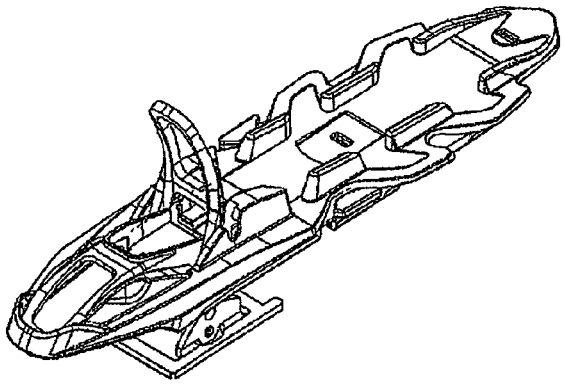
Figure 5:
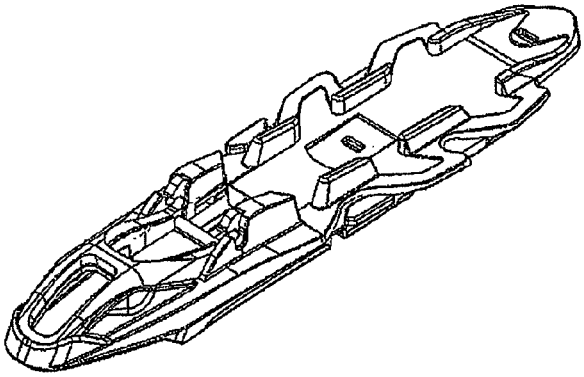

FIGS. 4 and 5 show the integration of the locking mechanism 30 with the elongate member 4 of the ski binding 1. In particular, the elongate member 4 may be provided with an appropriately shaped recess 5 on the underside thereof. In one embodiment, shown in FIG. 4, the locking mechanism 30 is fully constructed, and is passed from beneath through a hole 6 in the elongate member 4 to engage with the recess 5. The hole 6 is preferably large enough to allow the elongate arm members 33 to pass therethrough, but not large enough to allow the planar resting portion 11 therethrough, thus attaching the locking mechanism 30 to the elongate member 4 of the ski binding 1. As is seen in the figures, the elongate arm members 33 are shown attached at the non-hook portion 35 end, in order to provide a single piece. This is only one possible design option, and obviously the elongate arm members 33 could be provided without this integral connection, and thus be independently operable.

A further mechanism for attaching the locking mechanism 30 to the ski binding 1, is shown in FIG. 5. In this embodiment, the hole, or holes 6, in the elongate member 4 are only large enough to allow the hook portion 35 end of the elongate arm members 33 therethrough. By passing the locking means 31 through the one or more holes 6 to the underside of the elongate member 4, allows for the integration of the locking means 31 to the base portion 10 by means of the axle pin 32. Again, the planar resting portion 11 of the base portion 10 cannot pass through from the lower side of the elongate member 4, thus holding the locking mechanism 30 to the ski binding 1.

It is further possible to provide the elongate member 4 with a dip or flange toward the front portion thereof. This clip or flange could be structured to receive the front portion of the locking means 31, when they are in the locked orientation. If this clip or flange were provided with a snap-fit configuration, this could provide a suitable mechanism of improving the locking of the locking means 31 in the locked orientation. Further, if the clip or flange were to cover the front of the locking means 31 when in the locked orientation, this would reduce the chances of the skier hitting the locking means 31 with a ski pole and accidentally opening the binding.

It would be possible to also fabricate the base portion 10, as described above, be means of multiple structured pieces which are welded together. Whilst this is possible, it is less desirable than the above single sheet approach, as it is much more complex to manufacture. Additionally, the use of a weld is undesirable as this weld is most likely to be rather small, which is quite likely to lead to a high failure rate. Further, the base portion 10 will be subject in use to a variety of different temperatures, which will typically have a detrimental affect on such a small weld.

Whilst the above description has been given describing various features of the base portion 10, locking mechanism 30 and ski binding 1, it is not intended that any specific combination of features should be considered as necessary or disclosed. Indeed, the skilled person will appreciate that the essence of the present disclosure relates to the low positioning of the axle pin hole 13 in the base portion 10, and that further aspects of the base portion 10 and locking mechanism 30 can be appropriately adjusted around this central tenet. In particular, no fixed combination of features should be derived from the above description, and it is considered that all possible combinations and permutations of features presented should be considered as independently disclosed.

---

1 Ski binding
2 Rotation pin
3 Ski boot
4 Elonqate member
5 Recess
6 Hole
10 Base portion
11 Planar resting portion
12 Support sections
13 Axle pin hole
14 Lowest section
15 Upper surface
16 Boot pin indent
17 Upper edge
18 Cut out
19 The bend
20 Lower surface
21 Axle -continued

| |
|---|
| 30 Locking mechanism |
| 31 Locking means |
| 32 Axle pin |
| 33 Arm members |
| 34 Secondary axle pin holes |
| 35 Hook portions |
| 40 Patterned sheet |
| 41 Rigid sheet |
| 42 Support sections |

The invention claimed is:

1. Ski binding for cross country skiing or touring skiing, the ski binding comprising a base portion for a rotational locking mechanism, the base portion comprising a planar resting portion, one or more support sections extending out of the plane of the planar resting portion, each of the support sections comprising an axle pin hole for receiving an axle of a part associated with the rotational locking mechanism, the base portion comprising a boot pin indent for accepting a rotation pin of a ski boot, the rotational locking mechanism comprising a locking means rotatably connected to the base portion, the locking means comprising two elongate arm members which have hook portions for holding the rotation pin of the ski boot to the locking mechanism, the hook portions being provided on the elongate arm members near secondary axle pin holes, the locking means and the base portion being rotatably connected through the axle pin hole and the secondary axle pin holes by means of the axle, the hook portions overlapping with the boot pin indent in the locked orientation.

2. Ski binding according to claim 1, the hook portions being curved such that when the elongate arms are in the locked orientation, the resulting holes defined by the inner surfaces of the hook portion and the lower portion of the boot indent are circular.

3. Ski binding according to claim 1, the hook portions being curved such that when the elongate arms are in the locked orientation, the resulting holes defined by the inner surfaces of the hook portion and the lower portion of the boot indent are the same size as the rotation pin of the ski boot.

4. Ski binding according to claim 1, the hook portions being curved such that when the elongate arms are in the locked orientation, the resulting holes defined by the inner surfaces of the hook portion and the lower portion of the boot indent provides near 100% coverage around the rotation pin of the ski boot.

5. Ski binding according to claim 4, lower portion of the boot indent being U-shaped.

6. Ski binding according to claim 3, lower portion of the boot indent being U-shaped.

7. Ski binding according to claim 2, lower portion of the boot indent being U-shaped.

* * * * *